US007018977B2

(12) United States Patent
Martens et al.

(10) Patent No.: US 7,018,977 B2
(45) Date of Patent: Mar. 28, 2006

(54) RINSE-ADDED FABRIC TREATMENT COMPOSITION, PRODUCT CONTAINING SAME AND METHODS THEREOF

(75) Inventors: Vera Maria Martens, Andenne (BE); Frederic Bernard Robin, Ixelles (BE); Victor Javier Moses Aguilar, Waterloo (BE); Jean-Luc Philippe Bettiol, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 51 days.

(21) Appl. No.: 10/439,496

(22) Filed: May 16, 2003

(65) Prior Publication Data

US 2003/0216282 A1 Nov. 20, 2003

Related U.S. Application Data

(60) Provisional application No. 60/381,401, filed on May 16, 2002.

(51) Int. Cl.
*C11D 3/00* (2006.01)
*C11D 9/00* (2006.01)
*D06L 3/00* (2006.01)

(52) U.S. Cl. ..... 510/521; 510/504

(58) Field of Classification Search ..... 510/514, 510/521, 522
See application file for complete search history.

(56) References Cited

U.S. PATENT DOCUMENTS 3,163,606 A * 12/1964 Viveen et al. ..... 252/98
3,360,470 A * 12/1967 Wixon ..... 510/308
4,045,358 A 8/1977 Ramachandran
4,166,794 A 9/1979 Grey
4,430,236 A 2/1984 Franks
4,460,487 A 7/1984 Robinson et al.
5,071,573 A 12/1991 Coffindaffer et al.

FOREIGN PATENT DOCUMENTS

EP 0086423 A2 8/1983
WO WO 98/06803 2/1998
WO WO 99/42547 8/1999
WO WO 01/98447 A2 12/2001

* cited by examiner

*Primary Examiner*—Yogendra N. Gupta
*Assistant Examiner*—John M. Petruncio
(74) *Attorney, Agent, or Firm*—Mark A. Charles; Jason J. Camp; Steven W. Miller

(57) ABSTRACT

A rinse-added fabric treatment composition for reducing detergent residue and/or for improving the color and/or clarity of the rinse solution contains an agent for removing residual detergent surfactants from laundered fabrics and an appearance-enhancing selected from a peroxygen bleach, bluing agent and mixtures of the same. An antifoaming or suds suppressing material is optional but highly preferred for reducing the formation of suds during the rinsing of the laundered fabrics. Moreover, methods and uses of the compositions for improving the color and/or clarity of the rinse solution are included. A fabric treatment product for reducing detergent residue and/or for improving the color and/or clarity of the rinse solution includes a rinse added fabric treatment composition, a container for the composition and set of instructions concerning the use of the composition to improving the color and/or clarity of the rinse solution.

17 Claims, No Drawings

RINSE-ADDED FABRIC TREATMENT COMPOSITION, PRODUCT CONTAINING SAME AND METHODS THEREOF

CROSS REFERENCE TO RELATED APPLICATIONS

This application claims the benefit under 35 U.S.C. § 119(e) of U.S. Provisional Application Ser. No. 60/381,401, filed May 16, 2002.

BACKGROUND OF THE INVENTION

1. Field of the Invention

The present invention relates to rinse-added treatment compositions for fabrics, in particular, compositions for the hand rinsing of fabrics as well as the rinsing of fabrics in top loaded non-automated washing machines as well as automated washing machines after the fabrics have been laundered with a detergent composition. More specifically, the present invention relates to fabric treatment compositions and methods for use in removing laundry residue from laundered fabrics and/or for improving the color and/or clarity of the rinse solution.

2. Description of the Prior Art

The trend for washing is to use a washing machine wherein the laundry detergent and a fabric softening composition are dispensed from the washing machine via two separate compartments, thereby ensuring the automated release of the detergent at the beginning of the washing process and the release of the softening composition in the rinse process, usually near the end of the rinse process, or where multiple rinses are selected, during the final rinse process.

In most countries under development, the consumer's washing habit is to wash their garments with either non-automated top loaded washing machines (i.e. apparatus which comprises two separated cubicles, one for washing or rinsing, and one for spinning), or in basins or buckets. The washing in basins or buckets involves a manual operation with the multiple cumbersome steps of damping the fabrics, washing with detergent, wringing, and rinsing one or more times with water. Similarly, when washing in non-automated top loaded washing machines, the washing is operated by placing the fabric with detergent in the cubicle containing water, providing agitation, removing the fabrics from the cubicle containing the detergent liquor, placing the fabric in the spinning cubicle for spinning step, emptying the detergent liquor from the other cubicle and replace it by fresh water and then put back the spinned fabrics for rinsing. The steps of spinning, rinsing, and spinning being often reiterated several times to obtain acceptably rinsed fabrics. As such rinsing is usually done with clean water, this method of rinsing can be a major problem in regions experiencing water shortages.

Further, hand-washing is not limited to any particular geographical region. Although certain areas having limited access to modern appliances have a higher prevalence of hand washing, the need for hand-washing, including manual rinsing, is universal at least with respect to certain items of clothing and fabric articles. Hence, even with modern washing machines having a dedicated rinsing step, there are still many garments, especially those manufactured from "fine fabric" material (i.e. silk) or those which comprise "soft woven" material (i.e. woolen knitted sweaters) that are commonly "laundered by hand". "Delicates" and/or "personal" articles typically require hand-washing for proper care.

There are several disadvantages associated with hand washing. Foremost, hand washing typically limits the temperature at which the fabrics are washed, usually within a range tolerable to the person washing the garment. In addition, hand washing and/or washing in non-automated top loaded washing machines, typically is accompanied by high detergent to water ratio and/or high soil to water ratio (high soil loading). During such laundering the fabrics usually become saturated with residual detergent and/or dirt and particulate matter upon transfer to the rinse step.

Although this saturation problem is more acute with manual washing and/or washing in non-automated top loaded washing machines, it is also a problem for automated washing machines when the rinsing process is too short or is inefficient due to the characteristics of the particular articles being laundered. For instance, it is not uncommon in automated machines for the consumer to overload the machine or to program too little water for the amount of fabrics being laundered. In either case, the fabrics will not be thoroughly rinsed at the completion of the rinse cycle. Automated machine washing is also characterized by a high detergent to water ratio such that laundered fabrics are commonly saturated with residual detergent at the beginning of the rinse cycle. Further, the use of conventional detergent products such as the so called "High Suds Detergents" in any washing method commonly results in suds being carried over to the rinse bath solution requiring additional time, energy and water to thoroughly rinse the laundered fabrics.

Accordingly, there is a need for methods and compositions that will relieve or ease the burden of washing by providing a more efficient rinse bath solution that will allow the consumer to thoroughly rinse their laundered fabrics in a single rinse process.

There is also a need for methods and compositions that can improve the removal of foreign materials and laundry residue from fabrics. The removal of these laundry residues tends to restore fabrics to their natural softness and feel as well as their original whiteness and/or color. Furthermore, the removal of laundry residues also removes allergens and skin irritants that might have been deposited on the fabrics during previous wear or during the laundering process.

In addition, there is a need for a fabric treatment composition and methods relating to the use of such compositions to improve the color and/or clarity of the fabric rinse solution.

SUMMARY OF THE INVENTION

The present invention relates to a rinse-added fabric treatment composition that reduces residue on rinsed fabric and/or improves the color and/or clarity of the rinse solution. The composition includes an appearance-enhancing agent to improve the clarity and/or color of the rinse solution, a residue-reducing component, and the balance adjunct ingredients. The appearance-enhancing agent is a peroxygen bleach, a bluing agent, or mixture thereof. The residue reducing component is selected from a suds suppressing agent, pH control agent, metal ion control agent, crystal growth inhibitor, dispersant, cyclodextrin and derivatives thereof, scum dispersant, anionic surfactant scavenger, and mixtures thereof. The anionic surfactant scavenger is a cationic or zwitterionic quaternary ammonium compound or mixtures thereof and preferably has the structure:

(Formula 1)

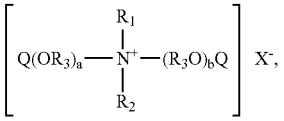

wherein $R_1$ is a $C_{12-15}$ alkyl group, wherein $R_2$ is methyl, wherein each $R_3$ is ethyl, wherein each Q is H, wherein a is about 7.5, wherein b is about 7.5, and wherein $X^-$ is chloride.

The present invention further provides for the use of a bleaching agent in a rinse-added fabric treatment composition to improve the color and/or clarity of the rinse solution. Similarly, the invention provides for the use of a bluing agent in a rinse-added fabric treatment composition to improve the color and/or clarity of the rinse solution.

In a process aspect, the present invention provides methods for improving the color and/or clarity of a laundry rinse solution while reducing residues on left on fabrics rinsed in that rinse solution. The methods comprise the steps of washing fabrics in an aqueous detergent solution, adding a rinse-added fabric treatment composition of the present invention to an aqueous rinse solution and rinsing the fabrics in that rinse solution. The fabric treatment composition comprises an effective amount of an appearance-enhancing agent selected from the group consisting of peroxygen bleach, a bluing agent, or mixtures thereof. Preferably, the methods relate to improving the color and/or clarity of a rinse solution that is used to rinse fabrics by hand.

The present invention further provides for fabric treatment products that include a rinse-added fabric treatment composition according to the present invention, a container for the composition, and a set of instructions associated with the container. The set of instructions includes an instruction to use the fabric treatment composition to improve the color and/or clarity of the rinse solution. Preferably, the set of instructions includes an instruction to use the fabric treatment composition when rinsing fabrics by hand.

In a further process aspect of the present invention, various methods for removing residue from laundered fabrics are provided. These methods comprise the steps of providing a composition of the present invention and dispensing an effective amount of the composition in an aqueous rinse bath solution. Manipulating or agitating the fabrics in the rinse solution to remove laundry residue from the laundered fabrics.

These and other features, aspects, advantages, and variations of the present invention, and the embodiments described herein, will become evident to those skilled in the art from a reading of the present disclosure with the appended claims, and are covered within the scope of these claims.

DETAILED DESCRIPTION OF THE INVENTION

All documents cited are, in relevant part, incorporated herein by reference; the citation of any document is not to be construed as an admission that it is prior art with respect to the present invention.

All percentages, ratios and proportions herein are by weight, unless otherwise specified. All temperatures are in degrees Celsius (°C.) unless otherwise specified. All documents cited are incorporated herein by reference in their entireties. Citation of any reference is not an admission regarding any determination as to its availability as prior art to the claimed invention.

As used herein, the term "alkyl" means a hydrocarbyl moiety, which is straight or branched, saturated or unsaturated. Unless otherwise specified, alkyl moieties are preferably saturated or unsaturated with double bonds, preferably with one or two double bonds. Included in the term "alkyl" is the alkyl portion of acyl groups.

As used herein, the term "laundry residue" means any material that may be present either on the fabrics or in the wash liquor during the wash cycle of the laundering process and that is carried over with the laundered fabrics into the rinse bath solution. Thus, "laundry residue" includes but is not limited to, residual soils, particulate matter, detergent surfactants, detergent builders, bleaching agents, metal ions, lipids, enzymes and any other materials that may have been present in the wash cycle solution. Furthermore, excess laundry liquor may be squeezed, wrung, or spun out of a fabric prior to remove excess laundry residue, prior to adding the fabric to the rinse bath solution. However, such laundry residue is not otherwise removed (i.e., rinsed out of the fabric with water) prior to adding the fabric to a rinse bath solution. Preferably, laundry residue includes "surfactant residue", which means that a surfactant material that may be present either on the fabrics or in the wash liquor during the wash cycle of the laundering process and that is carried over with the laundered fabrics into the rinse bath solution. Surfactant residue is removably-attached to the fabric surface and/or fabric fibers via hydrophilic attractions, calcium bridging, and/or other types of weak, non-covalent bonds.

As used herein, "rinse bath solution" is the solution used to rinse the fabrics subsequent to their washing. The rinse bath solution may be used in an automated or non-automated washing machine, or in the case of hand washing, may be used in a simple container such as a basin or bucket. The rinse bath solution is initially water before the laundered fabrics and accompanying laundry residue and/or the rinse-added fabric treatment composition are introduced.

I. Rinse-Added Fabric Treatment Composition

The compositions of the present invention comprise an appearance-enhancing agent to improve the clarity and/or color of the rinse solution, a residue-reducing component, and the balance adjunct ingredients.

A. Appearance-Enhancing Agent

The appearance-enhancing agent of the compositions of the present invention is preferably selected from the group consisting of a peroxygen bleaching agent, bluing agent and mixtures thereof. The specific amount of the appearance-enhancing agent present in the liquid fabric treatment composition will varying depending on its/their identity but should be present in at a quantity that is effective to improve the color and/or clarity of the rinse solution. An improvement in the color of the rinse solution will be recognized as a softening or lightening of the solution's existing color or a change of the existing color. Improvements in the clarity of the rinse solution will be recognized as an alteration of the solution so that it is less opaque and more translucent.

1. Peroxygen Bleaching Agent

The appearance-enhancing agents of the present invention can include a peroxygen bleaching agent. The fabric conditioning compositions of the present invention can comprise peroxygen bleach between about 3% and about 20%, preferably between about 5% and about 15% by weight of the composition.

This bleaching agent may comprise any conventional peroxygen bleach as are known and described in the art. Examples of suitable peroxygen bleaches include hydrogen peroxide, sodium peroxide, the perborates, percarbonates, persulfates, persilicates, peroxy disulphates, perphosphates and the crystalline peroxyhydrates formed by reacting hydrogen peroxide with urea or an alkali metal carbonate. The peroxygen bleach is preferably water-soluble. Suitable peroxygen bleaches are described in U.S. Pat. No. 4,273,661, issued Jun. 16, 1981 to Grey; U.S. Pat. No. 4,203,852 issued May 20, 1980 to Johnson et al.; and U.S. Pat. No. 5,077,119 issued Dec. 31, 1991 to Wraige, all of which are incorporated herein by reference. Hydrogen peroxide is the preferred peroxygen bleach because of its reduced tendency to interfere with the stability and/or functionality of the fabric conditioning composition.

2. Bluing Agent

A second appearance-enhancing agent is a bluing agent comprising a dye or pigment material. While it is recognized that the use of bluing agents in the formulation of fabric conditioning compositions is known, the use of such materials has been limited to low levels that will provide a desired color to the fabric treatment composition itself. The inclusion of bluing agents in such compositions has not addressed the color or appearance of the rinse solution into which the composition is to be dispensed. Therefore, the fabric conditioning compositions of the present invention comprise a bluing agent at level between about 0.001% and about 0.1%, and preferably between about 0.004% and about 0.1% by weight of the fabric treatment composition.

Bluing agents suitable for use in the fabric treatment compositions of the present invention are characterized by their ability to provide color to the rinse solution, preferably a blue or green hue. The bluing agent should be a water-soluble dye or a water-insoluble pigment capable of dispersion in water. Examples of dyes and pigments which can be utilized in this invention are: Polar Brilliant Blue GAW 180 percent sold by Ciba-Geigy S. A., Basel, Switzerland (similar to C.I. ["Color Index"] 61135—Acid Blue 127); FD&C Blue No. 1 (C.I. 42090), Rhodamine BM (C.I. 45170); Pontacyl Light Yellow 36 (similar to C.I. 18820); Acid yellow 23; Pigmasol blue; Acid blue 3; Polar Brilliant Blue RAW (C.I. 61585—Acid Blue 80); Phthalocyanine Blue (C.I. 74160); Phthalocyanine Green (C.I. 74260); and Ultramarine Blue (C.I. 77007—Pigment Blue 29). Additional examples of suitable bluing agents are described in U.S. Pat. No. 3,931,037 issued Jan. 6, 1976 to Hall and U.S. Pat. No. 5,605,883 issued Feb. 25, 1997 to Iliff et al., said patents incorporated herein by reference.

Where the bluing agent is to be used in combination with a peroxygen bleaching agent such as hydrogen peroxide, preferably the bluing agent is selected so as to be stable in the presence of that peroxygen bleach. The stability of a bluing agent for use in combination with a peroxygen bleaching agent may be determined by measuring the reduction in the reflectance of a composition containing the bluing agent after storage. A reduction in the measured level of reflectance of more than about 50% for a composition containing a given bluing agent is not acceptable and would be considered an unstable bluing agent.

Specifically, the reduction in reflectance may be determined by preparing a neat composition containing the peroxygen bleaching agent without bluing agent and diluting the neat composition to make a 10% solution. The reflectance of this composition is then measured using an Uvikon Spectrophotometer XL at the relevant wavelength in order to set a zero index value. The relevant wavelength will depend on the dye or pigment used in the bluing agent and will be known to those skilled in the art and in reference literature. For instance, 420 nm would be the relevant wavelength for obtaining the reflectance of a blue dye or pigment. Different wavelengths will be used depending on the specific bluing agent or combination of dyes or pigments used.

A second composition containing the selected bluing agent and the peroxygen bleaching agent is freshly prepared, diluted to a 10% solution and then measured to set a 100 index value. As the solution is freshly made the obtained reflectance at the relevant wavelength for the dye is maximum and is the 100 index value. The reflectance of the composition is then measured after storage at 50° C. for one month. By way of example, if the reflectance of the fresh composition without bluing agent is measured at 65% and the reflectance of the fresh composition with bluing agent is 95%, then bluing agents that give a composition having a reflectance of at least about 80% after storage are considered stable in the presence of the peroxygen bleaching agent.

Stable bluing agents include acid dyes, and more preferably, Acid Blue 80 or Pigmasol Blue 15.

3. Mixtures

The appearance-enhancing agents of the present invention may preferably comprise mixtures or combinations of peroxygen bleach and bluing agents.

B. Residue Reducing Component

The compositions of the present invention will comprise a residue reducing component that is preferably selected from the group consisting of suds suppressing agent, pH control agent, metal ion control agent, crystal growth inhibitor, dispersant, cyclodextrin and derivatives thereof, scum dispersant, anionic surfactant scavenger, and mixtures thereof.

1. Suds Suppression Agent

"Suds suppressing agent" as used herein refers to any compound or mixtures of compounds that act to depress the foaming or sudsing produced by a solution of a detergent composition, particularly in the presence of agitation of that solution. A wide variety of materials may be used as suds suppressers, and suds suppressers are well known to those skilled in the art. See, for example, Kirk Othmer Encyclopedia of Chemical Technology, Third Edition, Volume 7, pages 430–447 (John Wiley & Sons, Inc., 1979). Suitable suds suppressing systems for use herein may comprise essentially any known antifoam compound, including, for example a silicone antifoam compound, polyethylene glycol derivatives, a fatty acids and their salts, alcohol antifoam compounds such as secondary alcohols like the 2-alkyl alkanol antifoam compounds, high molecular weight hydrocarbons such as the paraffin antifoam compounds, copolymers of ethylene oxide and propylene oxide, and mono-alkyl quaternary ammonium compounds, and mixtures thereof.

A suds suppressing agent is a particularly desired component when the detergent used to wash the fabrics comprises high foaming surfactant, such as the conventional $C_{11}$–$C_{18}$ alkyl benzene sulfonates ("LAS"). When present, the suds suppressing agent is at a level of from 0.01% to 99%, more preferably from 0.1% to 50%, most preferably from 0.5% to 5% by weight of the composition. More specifically, when the suds suppressing agent comprises a monocarboxylic fatty acid and salt thereof, the suds suppressant will typically be present up to about 10%, and preferably from about 3% to about 7%, by weight of the composition. When silicone antifoam compounds are utilized, amounts up to about 10%, preferably from about 0.05% to about 6%, and more preferably from about 0.1% to about 5%, by weight of the composition are typical. The silicone antifoam compound weight percentage includes any silica that may be utilized in combination with polyorganosiloxane, as well as any adjunct materials that may be utilized.

Without intending to be limited by theory, it is believed that a silicone antifoam compound is especially preferred, as they are generally more effective at reducing the surface tension at the air-water interface, while not detrimentally affecting the benefit of the residue reduction agent (if present) at the fabric-water interface. Such silicone antifoam compounds also typically contain a silica component. The term 'silicone' as used herein, and in general throughout the industry, encompasses a variety of relatively high molecular weight polymers containing siloxane units andhydrocarbyl group of various types like, the polyorganosiloxane oils, such as polydimethylsiloxane, dispersions or emulsions of polyorganosiloxane of is or resins, and combinations of polyorganosiloxane with silica particles wherein the polyorganosiloxane is chemisorbed or fused onto the silica.

Silicone suds suppressers are well known in the art and are, for example, disclosed in U.S. Pat. No. 4,265,779, issued May 5, 1981 to Gandolfo, et al., and European Patent Application No. 3. 89307851-9, published Feb. 7, 19901 by Starch, M. S. Other silicone suds suppressers are disclosed in U.S. Pat. No. 3,455,839 to Rauner, issued Jul. 15, 1969, that relates to compositions and processes for defoaming aqueous solutions by incorporating small amounts of polydimethylsiloxane fluids. Mixtures of silicone and silanated silica are described, for instance, in German Patent Application DOS 14,124,526 to Bartolotta and Eymery issued Jun. 28, 1979. Silicone defoamers and suds controlling agents in granular detergent compositions are disclosed in U.S. Pat. No. 3,933,672 to Bartolotta, et al., issued Jan. 20, 1976, and in U.S. Pat. No. 4,652,392 to Baginski, et al., issued Mar. 24, 1987.

A highly preferred silicone antifoam compound mixture is commercially available under the tradename DOW CORNING® 2-3000 ANTIFOAM, from Dow Corning (Midland, Mich., USA), and under DOW CORNING® 544 ANTIFOAM, DOW CORNING® 1400 ANTIFOAM, DOW CORNING® 1410 ANTIFOAM, Silicone 3565, and other similar products available from Dow Corning. Other highly preferred suds suppressers useful herein include SE39 silicone gum and S-339 methyl siloxane antifoaming agents that are commercially available from Wacker-Chemie GmbH (Burghausen, Germany). In addition, a silicone antifoam compound may provide a thickening benefit without adversely affecting the dissolution profile of the rinse-added fabric treatment composition. This is especially useful where a high viscosity rinse-added fabric treatment composition is desired.

The silicone suds suppressors suitable for use herein preferably include polyethylene glycol and a copolymer of polyethylene glycol/polypropylene glycol, all having an average molecular weight of less than about 1,000, and preferably of from about 100 to about 800. The polyethylene glycol and polyethylenelpolypropylene copolymers herein have a solubility in water at room temperature of more than about 2 wt %, and preferably more than about 5 wt %. The preferred solvent herein is polyethylene glycol having an average molecular weight of less than about 1,000, more preferably of from about 15 to about 800, and more preferably of from about 200 to about 400, and a copolymer of polyethylene glycol/polypropylene glycol, preferably PPG 200/PEG 300. Preferably, the suds suppresser has a weight ratio of polyethylene glycol:copolymer of polyethylene-polypropylene glycol of from about 1:1 to about 1:10, and more preferably of from about 1:3 to about 1:6.

Alternatively, a polymeric suds suppresser may be present in place of a silicone antifoam compound. Specifically, a polyethylene glycol or derivative thereof may be used as the suds suppresser without a silicone containing compound present. Commercially available PEG derivatives suitable for use as a suds suppressing agent in the present invention include Ablunol TM20OMO, 400MS and 600ML from Taiwan Surfactants; Carbowax Sentry™ PEG 1000 or 3350 available from Union Carbide; PluroniX™, Meroxapol 105, Pluracol W5100N and Poloxamer 108 available from BASF; and Radiasurf™ 7423 available from FinaChernicals. See also U.S. Pat. No. 4,978,471 to Starch, issued Dec. 8, 1990, and U.S. Pat. No. 4,983,316 to Starch, issued Jan. 8, 1991, and U.S. Pat. No. 5,288,431 to Huber, et al., issued Feb. 22, 1994.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids and salts thereof typically have hydrocarbyl chains of about 10 to about 24 carbon atoms, such as tallow polycarboxyglycinate commercially available under the trade name TAPAC. Suitable soluble salts include the alkali metal salts such as sodium, potassium, and lithium salts, and ammonium and alkanol ammonium salts.

Other suitable antifoam compounds include, for example, high molecular weight hydrocarbons such as paraffin, light petroleum odorless hydrocarbons, fatty esters (e.g. fatty acid triglycerides, glyceryl derivatives, polysorbates), fatty acid esters of monovalent alcohols, aliphatic C18–C40 ketones (e.g. stearone) N-alkylated aminotriazines such as tri- to hexa-alkylmelamines or di- to tetra alkyldiamine chlorotriazines formed as products of yanuric chloride with two or three moles of a primary or secondary amine containing about 1 to about 24 carbon atoms, propylene oxide, bis stearic acidamide and monostearyl phosphates such as monostearyl alcohol phosphate ester and monostearyl dialkali metal (e.g., K, Na, and Li) phosphates and phosphate esters, quaternary ammonium compounds, di-alkyl quaternary compounds, poly fictionalized quaternary compounds, and nonionic polyhydroxyl derivatives.

The hydrocarbons, such as paraffin and haloparaffin, can be utilized in liquid form. The liquid hydrocarbons will be liquid at room temperature and atmospheric pressure, a minimum boiling point not less than 110° C. (atmospheric pressure). Waxy hydrocarbons are also suitable, preferably having a melting point below about 10° C. Hydrocarbon suds suppressers are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term 'paraffin' as used in this suds suppresser discussion, is intended to include mixtures off true paraffins and cyclic hydrocarbons.

Copolymers of ethylene oxide and propylene oxide, particularly the mixed ethoxylated/propoxylated fatty alcohols with an alkyl chain length of from about 10 to about 16 carbon atoms, a degree of ethoxylation of from about 3 to about 30 and a degree of propoxylation from about 1 to about 10, are also suitable antifoam compounds for use herein. Ethoxylated fatty alcohols for use as a suds suppressing agent in the compositions of the present invention are available from Lipo Chemicals. An example of a block copolymer useful as a suds suppressing agent is Prox-onic™ EP 2080-1 available from Protex International.

Other suds suppressers useful herein comprise the secondary alcohols (e.g., 2-alkyl alkanols as described in DE 40 21 265) and mixtures of such alcohols with silicone, such as the silicones disclosed in U.S. Pat. Nos. 4,798,679, 4,075,118 and EP 150,872. Mixtures of alcohols and silicones typically comprise a weight ratio of alcohol:silicone between about 1:5 and about 5:1. Preferred secondary alcohols include the C6–C16 alkyl alcohols having a C1–C16 chain. Examples include the 2-Hexyldecanol commercially available under the trade name SOFOL16, 2-Octyldodecanol sold under the trade name ISOFOL20, and 2-butyl octanol, sold under the trade name ISOFOL 12 from Condea. Adol 80 is another oleyl alcohol, sold by The Procter & Gamble Company, which is a useful suds suppressing agent. Mixtures of secondary alcohols are available under the trademark ISALCHEM 123 from Enichem.

Other suitable antifoams, described in the literature such as in Hand Book of Food Additives, ISBN 0 07592-X, p8O4, are selected from dimethicone, poloxamer, polypropylene glycol, tallow derivatives, and mixtures thereof.

2. pH Control Agent

A highly preferred aspect of the compositions of the present invention is that they have a pH in a 0.2% solution in distilled water at 20° C. of less than about 7, preferably from about 1.5 to about 6.5, more preferably from about 2 to about 6. The use of this acid pH range is desirable for the compositions as it enables the rejuvenation of the smoothness of the fabric as well as a stain removal performance, in particular for bleach sensitive stains.

The pH of the compositions may be adjusted by the use of various acidifying agents. Preferred acidifying agents include inorganic and organic acids including, for example, carboxylate acids, such as citric and succinic acids, polycarboxylate acids, such as polyacrylic acid, and also acetic acid, boric acid, malonic acid, adipic acid, fumaric acid, lactic acid, glycolic acid, tartaric acid, tartronic acid, maleic acid, their derivatives and any mixtures of the foregoing. A highly preferred acidification acid is citric acid, which has the advantage of providing a rejuvenation of the natural smoothness of the fabric. The acidifying agent should be present in an amount effective to provide the above described pH level. Typical levels are from about 0.1% to about 50%, preferably from about 0.5% to about 25%, and more preferably about 2% to about 22%, by weight of the composition.

A buffering component is an optional but preferred component for maintaining the pH of the composition. Suitable pH buffering components for use herein are selected from the group consisting of alkali metal salts of carbonates, preferably sodium bicarbonate, polycarbonates, sesquicarbonates, silicates, polysilicates, borates, metaborates, phosphates, preferably sodium phosphate such as sodium hydrogenophosphate, polyphosphate like sodium tripolyphosphate, aluminates, and mixtures thereof, and preferably are selected from alkali metal salts of carbonates, phosphates, and mixtures thereof. Optimum buffering systems are characterized by good solubility, even in very hard water conditions (e.g. 30 gpg).

3. Metal Ion Control Agent

Heavy metal ion (HMI) sequestrants or chelants are useful components herein for optimum whiteness and HMI control. "Heavy metal ion sequestrants" refers to components which act to sequester (chelate) heavy metal ions. These components may also have calcium and magnesium chelation capacity, but preferentially they bind heavy metal ions such as iron, manganese and copper. These compounds are desired when the water is a tap water of low quality and consequently that comprises a high level of HMI. Heavy metal ion sequestrants are preferably present at a level of from 0.005% to 20%, more preferably from 0.1% to 10%, most preferably from 0.2% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water-soluble. The molar ratio of said counter cation to the heavy metal ion sequestrant is preferably at least 1:1.

Suitable heavy metal ion sequestrants for use herein include the organo aminophosphonates, such as the amino alkylene poly (alkylene phosphonates) and nitrilo trimethylene phosphonates. Preferred organo aminophosphonates are diethylene triamine penta (methylene phosphonate) and hexamethylene diamine tetra (methylene phosphonate). Other suitable heavy metal ion sequestrants for use herein include hydroxylethyldiphosphonic acids or polyphosphonates, and nitrilotriacetic acid and polyaminocarboxylic acids such as ethylenediaminotetracetic acid, ethylenetriamine pentacetic acid, or ethylenediamine disuccinic acid. A further suitable material is ethylenediamine-N,N'-disuccinic acid (EDDS), most preferably present in the form of its S,S isomer, which is preferred for its biodegradability profile. Still other suitable heavy metal ion sequestrants for use herein are iminodiacetic acid derivatives such as 2-hydroxyethyl diacetic acid or glyceryl imino diacetic acid, described in EPA 317 542 and EPA 399 133.

4. Crystal Growth Inhibitor

A crystal growth inhibitor may be used for optimum whiteness and calcium control, preferably at a level from about 0.005% to about 5%, more preferably from about 0.1% to about 2% by weight of the composition. The preferred crystal growth inhibitors of the present invention are selected from the group consisting of carboxylic compounds, organic di-phosphonic acids, organic mono-phosphonic acids, and mixtures thereof.

Non-limiting examples of carboxylic compounds which serve as crystal growth inhibitors include glycolic acid, polycarboxylic acids, polymers and co-polymers of carboxylic acids and polycarboxylic acids, and mixtures thereof. The inhibitors may be in its acid or salt form. Preferably the polycarboxylic acids comprise materials having at least two carboxylic acid radicals that are separated by not more than two carbon atoms (e.g., methylene units). The preferred salt forms include alkali metals; lithium, sodium, and potassium; and alkanolammonium. The polycarboxylates suitable for use in the present invention are further disclosed in U.S. Pat. No. 3,128,287, U.S. Pat. No. 3,635,830, U.S. Pat. No. 4,663,0711 U.S. Pat. No. 3,923,679; U.S. Pat. No. 3,835,163; U.S. Pat. No. 4,158,635; U.S. Pat. No. 4,120,874 and U.S. Pat. No. 4,102,903, each of which is included herein by reference.

Further suitable polycarboxylates include ether hydroxpolycarboxylates, polyacrylate polymers, copolymers of maleic anhydride and the ethylene ether or vinyl methyl ethers of acrylic acid. Copolymers of 1,3,5-trihydroxybenzene, 2,4,6-trisulphonicacid, and carboxymethyloxy succinic acid are also useful. Alkali metal salts of polyacetic acids, for example, ethylenediamine tetraacetic acid and nitrilotriacetic acid, and then alkali metal salts of polycarboxylates, for example, maleic acid, succinic acid, oxydisuccinic acid, polymaleic acid, benzene 1 3,5-tricarboxylic acid, carboxymethyloxysuccinic acid, are suitable for use in the present invention as crystal growth inhibitors. Examples of commercially available carboxylic compounds for use as crystal growth inhibitors include, polyacrylate polymers Good-Rite® ex BF Goodrich, Acrysol® ex Rohm & Haas, Sokalan® ex BASF, and Norasol® ex Norso Haas. Preferred are the Norasol® polyacrylate polymers, more preferred are Norasol® 410N (MW 10,000) and Norasol® 440N (MW 4000) which is an amino phosphonic acid modified polyacrylate polymer, and also more preferred is the acid form of this modified polymer sold as Norasol® QR 784(MW 4000) ex Norso-Haas.

Polycarboxylate crystal growth inhibitors include citrates, e.g., citric acid and soluble salts thereof (particularly sodium salt), 3,3-dicarboxy oxa-1,6-hexanedioatesand related compounds further disclosed in U.S. Pat. No. 4,566,984 incorporated herein by reference, C5–C20 alkyl, C5–C20 alkenyl succinic acid and salts thereof, of whichdoclecenyl succinate, lauryl succinate, myristyl succinate, palmityl succinate, 2-dodecenylsuccinate, 2-pentadecenyl succinate, are non-limiting examples. Other suitable polycarboxylates are disclosed in U.S. Pat. No. 4,144,226, U.S. Pat. No. 3,308,067 and U.S. Pat. No. 3.723,322, al. of which are incorporated herein by reference.

Organic diphosphonic acids are also suitable for use as crystal growth inhibitors. For the purposes of the present invention the term "organic diphosphonic acid" is defined as an organo-diphosphonic acid or salt which does not comprise a nitrogen atom". Preferred organic diphosphonic acids include C1–C4 diphosphonic acid, preferably C2 diphosphonic acid selected from the group consisting of ethylene diphosphonic acid, a-hydroxy-2 phenyl ethyl diphosphonic acid, methylene diphosphonic acid, vinylidene-1,11-diphosphonic acid, 1,2-dihydroxyethane-1,1-diphosphonic acid, hydroxy-ethane 1,1diphosphonic acid, the salts thereof, and mixtures thereof. More preferred ishydroxyethane-11-diphosphonic acid (HEDP).

Organic mono-phosphonic acids useful as crystal growth inhibitors are the organic monophosphonic acids, their salts or complexes and mixtures thereof. By organo monophosphonic acid it is meant herein an organo monophosphonic acid that does not contain nitrogen as part of its chemical structure. This definition therefore excludes the organo aminophosphonates that may be included in the present compositions as heavy metal ion sequestrants. The organo monophosphonic acid component may be present in its acid form or in the form of one of its salts or complexes with a suitable counter cation. Preferably any salts/complexes are water soluble, with the alkali metal and alkaline earth metals salts/complexes being especially preferred. A preferred organo-monophosphonic acid is 2-phosphonobutane-1,2,4-tricarboxylic acid commercially available from Bayer under the trade name of Bayhibit.

5. Dispersant

A dispersant can be used in the compositions of the present invention for suspending materials in the rinse and inhibiting their deposition on the laundered fabrics. Suitable dispersants include polymers and copolymers having carboxylate groups, polyethylene glycol and derivatives thereof, carboxymethylcellulose and derivative thereof, ethoxylated amine polymers, amine oxide polymers and cationic and zwitterionic polymers, succinate builders, fatty acids, phosphate builders, and mixtures thereof can all be used to advantage at levels from about 0.1% to about 7%, by weight of the composition. Polyaspartate and polyglutamate dispersing agents may also be used, especially in conjunction with zeolite builders.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylene malonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials and the use of materials of this type has been disclosed, for example, in Diehi, U.S. Pat. No. 3.308,067, issued Mar. 7, 1967.

Acrylic maleic-based copolymers may also be used as a preferred component of the dispersing anti-redeposition agent. Such materials include the water-soluble salts of copolymers of acrylic acid and maleic acid, for example, the alkali metal, ammonium and substituted ammonium salts. The average molecular weight of such copolymers in the acid form preferably ranges from about 2,000 to about 100,000, more preferably from about 5,000 to about 75,000, most preferably from about 7,000 to about 65,000. The ratio of acrylate to maleate segments in such copolymers will generally range from about 30:1 to about 1:1, more preferably from about 10:1 to about 2:1. Soluble acrylate/maleate copolymers of this type are described in European Patent Application No. 66915. Published Dec. 15, 1982, as well as in EP 193,360, published Sep. 3, 1986. Still other useful dispersing agents include the maleic acrylic/vinyl alcohol terpolymers such as are disclosed in EP 193,360, including for example, a terpolymer of acrylic/maleic vinyl alcohol.

Another polymeric material that can be included is polyethylene glycol (PEG). PEG can exhibit dispersing agent performance as well as act as a clay soil removal and anti-redeposition agent. Typical molecular weights for these purposes range from about 500 to about 100,000, preferably from about 1,000 to about 50,000, and more preferably from about 1,500 to about 10,000. Polyaspartate and polyglutamate dispersing agents may also be used, especially in conjunction with zeolite builders. Dispersing agents such as polyaspartate preferably have a molecular weight (avg.) of about 10,000.

A group of preferred clay soil removal/anti-redeposition agents are the cationic compounds disclosed in European Patent Application 111,965, Oh and Gosselink, published Jun. 27, 1984. Other clay soil removal anti-redeposition agents which can bused include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti-redeposition agents known in the art can also be utilized in the compositions herein.

Another type of preferred anti-redeposition agent includes the carboxymethyl cellulose (CMC) materials as are well known in the art.

Also suitable in the compositions of the present invention are the 3,3-dicarboxy 4-oxa-1,6-hexanedioates and the related compounds disclosed in U.S. Pat. No. 4,566,984, Bush, issued Jan. 28, 1986. Useful succinic acid builders include the C5–C20 alkyl and alkenyl succinic acids and salts thereof. A particularly preferred compound of this type is dodecenyl succinic acid. Specific examples of succinate builders include: lauryl succinate, myristyl succinate, palmityl succinate, 2-dodecenyisuccinate (preferred), 2-pentadecenylsuccinate, and the like. Lauryl succinates are the preferred builders of this group, and are described in European Patent Application 86200690.5, published Nov. 5, 1986.

Fatty acids, e.g., C12–C18 monocarboxylic acids, can also be incorporated into the compositions alone, or in combination with the aforesaid builders, especially citrate and/or the succinate builders, to provide additional builder activity.

In situations where phosphorus-based builders can be used, and especially in formulations for hand-laundering operations, the various alkali metal phosphates such as 26 the well-known sodium tripolyphosphates, sodium pyrophosphate and sodium orthophosphate can be used. Phosphonate builders such as ethane hydroxy-1,1-diphosphonate and other known phosphonates (see, for example, U.S. Pat. Nos. 3.159,581; 3,213,030; 3,422,021; 3,400,148 and 3,422,137) can also be used.

6. Cyclodextrin

As used herein, the term 'cyclodextrin' includes any of the known cyclodextrins such as unsubstituted cyclodextrin containing from six to twelve glucose units, especially, alpha-cyclodextrin, beta-cyclodextrin, gamma-cyclodextrin and or their derivatives and/or mixtures thereof. Alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrin a rigid, conical molecular structure with hollow interiors of a specific volume. The internal cavity is formed by hydrogen atoms and glycosidic bridging oxygen; therefore, the surface of the cavity is fairly hydrophobic. The unique shape and physical-chemical properties of the cavity enable the cyclodextrin molecules to absorb (form inclusion complexes with) organic molecules or parts of organic molecules that can fit into the cavity. Many odorous and surfactant molecules can fit into the cavity, and therefore, cyclodextrins, and especially mixtures of cyclodextrins with different size cavities, can be used to eliminate a variety of organic residues. Cyclodextrins are typically used in the compositions of the present invention between about 0.5% and about 10% by weight.

Cyclodextrins that are useful in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mostly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins. Other cyclodextrin derivatives are disclosed in U.S. Pat. Nos. 3,426,011; 3,453,257; 3,453,258; 3,453,259; 3,453,260; 3,459,731; 3,553,191; 3,565,887; 4,535,152; 4,616,008; 4,678,598; 4,638,058; and 4,746,734.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient residue removal. Solubilized, water-soluble cyclodextrin can exhibit more efficient removal than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin.

Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-p-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12 RAMEB is more preferred than DIMEB, since DIMEB affects; the surface activity of the preferred surfactants more than RAMEB. The preferred cyclodextrins are available, e.g., from Cerestar USA, Inc. and WackerChemicals (USA), Inc.

7. Scum Dispersant

The soil releasing materials described below will typically also act as scum dispersants. However, the compositions of the present invention may also contain a scum dispersant other than these soil release agents. The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, molecules of ethylene oxide per molecule on the average, with the polyethylene oxide portion being from about 76% to about 97%, preferably from about 81% to about 94%, of the total molecular weight. The level of scum dispersant is sufficient to keep the scum at an acceptable, preferably unnoticeable to the consumer, level under the conditions of use. Preferred commercially available scum dispersants include: Brij 700®; Varonic U-250®; Genapol T-500®, Genapol T-800®; Plurafac A-79®; and Neodol 25–50®.

8. Surfactant Scavenger

The surfactant scavenger useful herein interacts with surfactant residue and removes the surfactant residue from a fabric surface by pulling the surfactant residue into solution. The surfactant scavenger is preferably tailored to the surfactant residue so as to include a "surfactant-attracting"

portion that is attracted to the surfactant residue's ionic moieties, hydrophobic moieties, and/or alkoxylated moieties. Typically, the surfactant-attracting portion forms a non-covalent bond, such as an ion pair, with the surfactant residue. For example, in order to remove an anionic surfactant residue, a cationic and/or a zwitterionic compound may be useful herein, whereas to remove other types of surfactant residues, such as nonionic surfactant residues and cationic surfactant residues, a nonionic residue reduction agent and an anionic compound may be respectively employed. Furthermore, the hydrophobic and/or hydrophilic moieties on the surfactant scavenger may be tailored to the specific surfactant residue targeted for removal, thereby improving overall surfactant residue removal. Thus, the surfactant scavenger typically contains a surfactant-attracting portion selected from a hydrophobic moiety, a charged moiety, and a combination thereof, preferably a charged moiety and more preferably a cationic moiety.

Since anionic surfactant residues cause the most concern for consumers, the surfactant scavenger is preferably a cationic and/or zwitterionic scavenger compound. The cationic and zwitterionic scavenger compounds useful herein typically have a quaternized nitrogen atom which is especially effective in forming an ion pair with an anionic surfactant residue. The surfactant scavenger useful herein typically contains one or more alkoxylated repeating groups along with "short" and "longer" alkyl groups, preferably with two alkoxylated repeating groups, one short chain alkyl group, and one long chain alkyl group attached to the quaternized nitrogen. The cationic and/or zwitterionic scavenger compounds useful herein preferably has the formula:

(Formula 1)

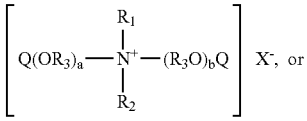

(Formula 2)

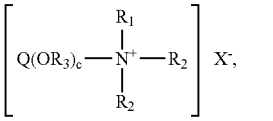

where $R_1$ is a saturated or unsaturated alkyl or aryl group having more than 4 carbon atoms, preferably more than about 10 carbon atoms, and more preferably from about 12 to about 25 carbon atoms. In addition, each $R_2$ is independently a $C_{1-4}$ alkyl group, preferably a $C_{1-2}$ alkyl group, and more preferably a methyl group, and each $R_3$ is independently a $C_{2-4}$ alkyl group preferably a $C_{2-3}$ alkyl group, and more preferably an ethyl group. In these formulas, a, b, and c denote average degrees of alkoxylation, and thus need not be integers. Thus, a and b are each independently from about 1 to about 20, preferably from about 3 to about 15, and more preferably from about 5 to about 10, while c is from about 1 to about 30, preferably from about 5 to about 20, and more preferably from about 10 to about 15.

Each Q is independently selected from H, $SO_3$—, $C_{1-4}$ alkyl, $CO_2$—, —$(CH_2)_dPO_3M$, —$(CH_2)_dOPO_3M$, —$(CH_2)_dSO_3M$, —$CH_2CH(SO_3M)CH_2SO_3M$, or —$CH_2CH(SO_2M)CH_2SO_3M$, where d is from about 1 to about 5, preferably from about 1 to about 3, and more preferably from about 1 to about 2, and where M is a cation providing charge neutrality or a mixture thereof, preferably M is a water-soluble alkali metal ion, an alkali earth metal ion, or a mixture thereof, and more preferably M is sodium ion, potassium ion, or a mixture thereof. Preferably, Q is selected from the group consisting of $SO_3$—, $CO_2$—, H, and a mixture thereof; and more preferably at least one Q is $SO_3$—. Finally, X— denotes an anion or a mixture thereof, preferably a water-soluble halide anion, and more preferably chloride ion, as needed, for providing charge neutrality.

The cationic and/or zwitterionic scavenger compounds may also have a plurality, and more preferably from about 2 to about 6 cationic nitrogen moieties. Without intending to be limited by theory, it is believed that such multiple cationic moieties further strengthen the attachment of the scavenger to an anionic surfactant. More preferably, the plurality of cationic nitrogen moieties are linked by a linker such as a straight or branched hydrocarbon backbone, preferably ethylene, propylene, isopropylene, hexamethylene, 1,4-dimethylenebenzene, and/or 4,9-dioxadodecylene.

Thus, the cationic and/or zwitterionic scavenger compounds useful herein include compounds of the formulas:

(Formula 3)

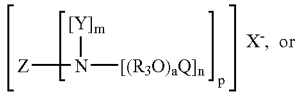

(Formula 4)

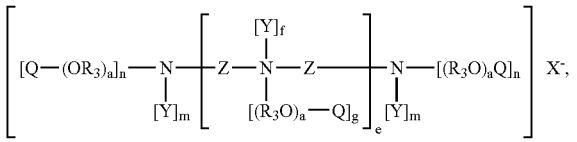

where Z is a straight or branched hydrocarbon backbone, preferably Z is selected from ethylene, propylene, isopropylene, hexamethylene, 1,4-dimethylenebenzene, and/or 4,9-dioxadodecylene. In Formula 3, p is from about 2 to about 6, preferably from about 2 to about 4. Each Y is independently selected from $R_1$ and $R_2$, as defined above for Formulas 1 and 2, and at least one Y is $R_1$. Also, each m and n are independently 1 or 2, where for each nitrogen moiety, the respective m+n=2 or 3. Furthermore, at least about 2 nitrogen moieties, preferably from about 2 to about 6 nitrogen moieties, and more preferably from about 2 to about 4 nitrogen moieties in Formula 3 are quaternized, such that their respective m+n=3. In Formula 3, $R_3$, Q, $X^-$ and a are defined as above, for Formulas 1 and 2.

In Formula 4, e represents the average number of linking groups and is from about 1 to about 6, preferably from about 1 to about 3, while each f is independently 0 or 1 and each g is independently 0 or 1. For each nitrogen moiety, the respective f+g=1 or 2. Furthermore, at least about 2 nitrogen moieties, preferably from about 2 to about 6 nitrogen moieties, and more preferably from about 2 to about 4 nitrogen moieties in Formula 4 are quaternized, such that their respective m+n=3, or their respective f+g=2. Except as specifically noted, $R_3$, Q, Y, $X^-$, a, m, and n, are as defined above for Formulas 1–3.

Cationic scavengers are typically present as a water-soluble salt, preferably with any cationic moieties being charge-balanced with a water-soluble halide, and more preferably with any cationic moieties being charge-balanced with a chloride ion. Furthermore, any anionic moieties on a zwitterionic scavenger such as sulfate, are typically charge-balanced with a water-soluble alkali metal ion, alkali earth metal ion, or a mixture thereof, preferably a water-soluble alkali metal ion, and more preferably sodium ion, potassium ion, or a mixture thereof.

While examples of such compounds are known per se, they have not been previously employed to remove surfactant residues from a fabric. Without intending to be limited by theory, it is believed that the above cationic scavengers possess many qualities that make them particularly suited towards removing surfactant residue, and especially anionic surfactant residue from fabric. Specifically, the $R_1$ group is hydrophobic, which helps attract the scavenger compound to the fabric. Once the scavenger compound is near the fabric, it is believed that the charged, cationic nitrogen moiety is easily attracted to the anionic moiety of an anionic surfactant residue to form an associated ion pair. However, it is also believed that the alkoxy moieties are sufficiently hydrophilic so as to draw the cationic scavenging compound and the accompanying surfactant residue into solution, and away from the fabric.

This "chaperone mechanism" for reducing surfactant residue by forming an ion pair and dragging the surfactant residue into solution is thus especially effective where the HLB of the scavenger compound, according to the Davies Scale, is from about 25 to about 35, more preferably from about 28 to about 33. Without intending to be limited by theory, it is also believed that such an HLB is highly predictive of the efficacy of the scavenging properties of the compound, as compounds having the above HLB are typically too hydrophilic to remain attached to a negatively-charged fabric fiber, and yet are sufficiently hydrophobic so as to be attracted to the liquid-fiber interface where it may then form an associated ion pair or other non-covalent bond with the surfactant residue and then chaperone it away from the fabric. Further, the surfactant scavenger having this HLB is sufficiently hydrophilic such that it does not typically deposit on fabric in appreciable amounts, but is washed away in the rinse dragging the anionic surfactant residue away from the fabric. This is significantly different from, for example, a cationic fabric softening active, whose HLB is significantly lower (i.e., more hydrophobic), and whose benefits are proportional to the amount of fabric softening active deposited onto the fabric.

Non-limiting, preferred examples of the surfactant scavenger useful herein include PEG-15 cocomonium chloride (CAS #61791-10-4) available as ETHOQUAD-C25 monochloride, from Akzo-Nobel Chemicals, Inc., Chicago, Ill., U.S.A.; PEG-17 cocomonium chloride (CAS #61791-10-4) available as Berol 556, from Akzo-Nobel Chemicals, Inc., Chicago, Ill., U.S.A.; PEG-10 palmityldimethylammonium chloride; and PEG-96 dicocoylhexamethyenediammonium chloride, available from BASF Chemicals, Ludwigshafen, Germany. In addition, non-limiting, preferred examples of the surfactant scavenger useful herein include forms of all these materials in which 0–100% of the available terminal EO moieties have been sulfated.

The surfactant scavenger is typically present in the rinse-added fabric treatment composition at a level of from about 0.05% to 10%, preferably from about 0.5% to about 8%, and more preferably from about 0.75% to about 5%, by weight of the composition. However, it is recognized that in certain cases, such as concentrated compositions, higher or lower levels may also be employed herein. Mixtures of the above surfactant scavengers are also useful herein, especially a combination of cationic and zwitterionic scavenger compounds.

C. Adjunct Ingredients

The fabric treatment compositions of the present invention may optionally, but preferably, will contain one or more of the following optional components.

1. Builders

The rinse-added fabric treatment compositions of the present invention may also comprise detergent builders to assist in controlling mineral hardness. Inorganic as well as organic builders can be used. Builders are typically used in fabric laundering compositions to assist in the removal of particulate soils. When present in the composition, the builder can comprise from at least about 1% to about 30% of the composition. A detailed description of suitable builders is provided in Applicant's co-pending application U.S. Ser. No. 09/885,697 filed Jun. 20, 2001 by Price et al. and in International Application Publication No. WO 01/98447 A2, published Dec. 27, 2001, said description incorporation herein by reference.

2. Stabilizers

In the presence of antifoam materials made of silicone, it is preferred to use a component that will provide a good stabilization of the silicone antifoam and hence of the composition. Typical levels of stabilizing agents are of from 0.01% to 20%, preferably from 0.5% to 8%, more preferably from 0.1% to 6% by weight of the composition. Suitable stabilizing agents to be used herein include synthetic and naturally occurring polymers. Suitable stabilizing agents for use herein include xanthan gum or derivatives thereof, alginate or a derivative thereof, polysaccharide polymers such as substituted cellulose materials like ethoxylated cellulose, carboxymethylcellulose, hydroxymethylcellulose, hydroxypropyl cellulose, hydroxyethyl cellulose and mixtures thereof. Xanthan gum is a particularly preferred stabilizer. Commercially available stabilizers include xanthan gum or derivatives thereof sold by the Kelco Division of Merck under the trade names KELTROL®, KELZAN AR®, KELZAN D35®, KELZAN S®, KELZAN XZ® and succinoglycan gum stabilizers, such as those available from Rhodia (St. Louis, Mo., USA).

Polymeric soil release agents are also useful in the present invention as stabilizing agents. These include cellulosic derivatives such as hydroxyether cellulosic polymers, ethoxylated cellulose, carboxymethylcellulose, hydroxymethylcellulose, hydroxypropyl cellulose, hydroxyethyl cellulose, and the like. Such agents are commercially available and include hydroxyethers of cellulose such as METHOCEL (Dow). Cellulosic soil release agents for use herein also include those selected from the group consisting of C1–C4 alkyl and C4 hydroxyalkyl cellulose; see U.S. Pat. No. 4,000,093, issued Dec. 28, 1976 to Nicol, et al.

3. Brighteners

Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners that are useful in the compositions of the present invention are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-stryl-phenyl)-2H-napthol[1,2-d]triazoles; 4,4'-bis-(1,2,3-triazol-2-yl-)-stil-benes; 4,4'-bis(stryi)bisphenyls; and the aminocoumarins. Specific examples of these brighteners include 4-methyl-7-diethyl-amino coumarin; 1,2-bis(-venzimidazol-2-yl)ethylene; 1,3-diphenyl-phrazolines; 2,5-bis(benzoxazol-2-yl)thiophene; 2-stryl-napth-[1,2-d] oxazole; and 2-(stilbene-4-yl)-2H-naphtho-[1,2-d]triazole. See also U.S. Pat. No. 3,646,015, issued Feb. 29, 1972 to Hamilton. Anionic brighteners are preferred for use in the compositions of the present invention.

4. Odor Control Agent

Materials for use in odor control may optionally be incorporated into the compositions of the present invention. Such materials may be of the type and amounts disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated herein by reference. Such compositions can contain several different optional odor control agents including pro-perfumes or pro-fragrances, low molecular weight polyols, metal salts, soluble carbonate and/or bicarbonate salts, enzymes, zeolites, activated carbon and mixtures thereof. A detailed description of suitable odor control agents is provided in Applicant's co-pending application U.S. Ser. No. 09/885,697 filed Jun. 20, 2001 by Price et al. and in International Application Publication No. WO 01/98447 A2, published Dec. 27, 2001, said description incorporation herein by reference. Such materials are well known in the art and are commercially available from a variety of manufacturers.

5. Solvents

Another optional, but preferred, ingredient is a liquid carrier. The liquid carrier employed in the instant compositions is preferably at least primarily water due to its low cost, relative availability, safety, and environmental compatibility. The level of water in the liquid carrier is preferably at least about 50%, most preferably at least about 60%, by weight of the carrier. Mixtures of water and low molecular weight, e.g., <about 200, organic solvent, e.g., lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

6. Soil Release Polymers

Optionally, the compositions herein contain from 0% to about 10%, preferably from about 0.1% to about 5%, more preferably from about 0.1% to about 2% by weight of a soil release polymer. Particularly useful soil release polymers comprise copolymeric blocks of terephthalate and polyethylene oxide or polypropylene oxide and the like as are described in U.S. Pat. No. 4,956,447 issued Sep. 11, 1990 to Gosselink et al. and EP Patent Application EP 185,427 published Jun. 25, 1986, said patent and patent application being incorporated herein by reference.

7. Preservatives

Optionally, but preferably, an antimicrobial preservative can be added to the compositions of the present invention. It is preferable to use a broad spectrum preservative, e.g., one that is effective on both bacteria (both gram positive and gram negative) and fungi, or a mixture such preservatives. Antimicrobial preservatives useful in the present invention include biocidal compounds.

The preservative can be any organic preservative material that will not cause damage to fabric appearance, e.g., discoloration, coloration, bleaching. Preferred water-soluble preservatives include organic sulfur compounds, halogenated compounds, cyclic organic nitrogen compounds, low molecular weight aldehydes, quaternary ammonium compounds, dehydroacetic acid, phenyl and phenolic compounds, and mixtures thereof. Non-limiting examples of preferred water-soluble preservatives for use in the present invention can be found in U.S. Pat. No. 5,714,137, incorporated hereinbefore by reference, as well as co-pending application PCT/US 98/12154 pages 29 to 36. Well known preservatives such as parabens, triclocarban, and triclosan are suitable for use in the present invention.

Still other preferred preservatives are the water-soluble preservatives. Preferred water-soluble preservatives for use in the present invention are organic sulfur compounds such as isothiazolone compounds such as are disclosed in U.S. Pat. No. 4,265,899, Lewis et al., issued May 5, 1981, and incorporated herein by reference. A preferred preservative is available as a 1.5% aqueous solution under the trade name Kathon® CG by Rohm and Haas Company. Other isothiazolins include 1,2-benzisothiazolin-3-one, available under the trade name Proxel® products; and 2-methyl-4,5-trimethylene-4-isothiazolin-3-one, available under the trade name Promexal®. Both Proxel and Promexal are available from Zeneca. Another preferred organic sulfur preservative is sodium pyrithione, with water solubility of about 50%. When sodium pyrithione is used as the preservative in the present invention it is typically present at a level of from about 0.0001% to about 0.01% by weight of the usage composition. Mixtures of the preferred organic sulfur compounds can also be used as the preservative in the present invention.

The preservative in the present invention is included at an effective amount. The term "effective amount" as herein defined means a level sufficient to prevent spoilage, or prevent growth of inadvertently added microorganisms, for a specific period of time. In other words, the preservative is being used to prevent spoilage of the solution in order to increase the shelf-life of the composition. Preferred levels of preservative are from about 0.0001% to about 0.5% by weight of the usage composition.

8. Antimicrobial Agents

Sanitization of fabrics can be achieved through the use of compositions containing, antimicrobial materials, e.g., antibacterial halogenated compounds, quaternary compounds, phenolic compounds and metallic salts, and preferably quaternary compounds. A typical disclosure of these antimicrobials and their usage levels can be found in International Patent Application No. PCT/US 98/12154, in Applicant's co-pending application U.S. Ser. No. 09/885,697 filed Jun. 20, 2001 by Price et al. and in International Application Publication No. WO 01/98447 A2, published Dec. 27, 2001, said descriptions incorporation herein by reference.

9. Perfume

Optionally, the compositions herein contain from 0% to about 5%, preferably from about 0.01% to about 2.5%, more preferably from about 0.1% to about 1% by weight of a perfume, pro-fragrance, or mixture thereof. Perfumes and pro-fragrances suitable for use in the 5 compositions of the present invention are described in detail in U.S. Pat. No. 6,093,691 issued Jul. 25, 2000 to Sivik et al. and U.S. Pat. No. 6,156,710 issued Dec. 5, 2000 to Sivik et al., both of said patents being incorporated herein by reference.

10. Other Optionals and Mixtures

The present invention composition may also include optional components conventionally used in textile treatment compositions, for example: chlorine scavengers, color care and color maintenance materials, surfactants; anti-shrinkage agents; fabric crisping agents; spotting agents; germicides; anti-corrosion agents, and mixtures thereof. Mixtures of the various optional components discussed herein may be used to advantage in the compositions of the present invention.

The invention is illustrated in the following non-limiting examples, in which all percentages are on a weight basis unless otherwise stated. The following are exemplary and should not be interpreted as limiting of its scope.

EXAMPLES

| | I | II | III | IV | V | VI | VII |
|---|---|---|---|---|---|---|---|
| Perfume | 0.2 | 0.2 | 0.2 | 0.2 | 0.2 | 0.2 | 0.2 |
| PH control agent[1] | 2 | 2 | 2 | 2 | 2 | 2 | 2 |
| Residue Reduction agent[2] | 0 | 0 | 0 | 0 | 2 | 2 | 2 |
| Silicone suds suppressant[3] | 1 | 1 | 1 | 1 | 1 | 1 | 1 |
| Chelating agents[4] | 1.8 | 1.8 | 1.8 | 1.8 | 1.82 | 1.8 | 1.8 |
| Dye[5] | 0.004 | 0.05 | 0.004 | 0.05 | 0.004 | 0.05 | 0.5 |
| Hydrogen peroxide | 0 | 0 | 5 | 5 | 15 | 15 | 15 |
| Water | Bal. | Bal. | Bal. | Bal. | Bal. | Bal. | Bal. |

| | VIII | IX | X | XI | XII | XIII | XIV |
|---|---|---|---|---|---|---|---|
| Perfume | 2 | 2 | 2 | 2 | 2 | 2 | 2 |
| PH control agent[1] | 15 | 15 | 15 | 15 | 15 | 15 | 15 |
| Residue Reduction agent[2] | 0 | 0 | 0 | 2 | 2 | 2 | 2 |
| Silicone suds suppressant[3] | 2 | 2 | 2 | 2 | 2 | 2 | 2 |
| Chelating agents[4] | 0.7 | 0.7 | 0.7 | 0.7 | 0.7 | 0.7 | 0.7 |
| Dye[5] | 0.004 | 0.05 | 0.004 | 0.05 | 0.004 | 0.05 | 0.05 |
| Hydrogen peroxide | 0 | 0 | 5 | 5 | 15 | 15 | 15 |
| Water | Bal. | Bal. | Bal. | Bal. | Bal. | Bal. | Bal. |

[1]Citric acid
[2]N, methyl N,N di(polyethoxyethyl), dodecyl ammonium chloride
[3]Wacker SE 39
[4]Sodium hydroxylethyl diphosphonic acid
[5]Pigmasol blue 15

II. Uses and Methods

The present invention further relates to the use of a peroxygen bleach in a rinse-added fabric treatment composition to improve the color and/or clarity of the rinse solution into which the fabric treatment composition is dispensed. Similarly, the present invention relates to the use of a bluing agent in a rinse-added fabric treatment composition to improve the color and/or clarity of the rinse solution into which the fabric treatment composition is dispensed.

The present invention also provides methods for improving the color and/or clarity of a fabric rinse solution. The method comprises the steps of washing fabrics in an aqueous detergent solution, rinsing the fabrics in an aqueous rinse solution, and adding a fabric treatment composition of the present invention to the rinse solution. As described hereinabove, the fabric treatment composition comprises an effective amount of a appearance-enhancing agent to improve the clarity and/or color of the rinse solution, the appearance-enhancing agent selected from the group consisting of a peroxygen bleach, a bluing agent, and mixtures thereof.

The uses and methods of the present invention are most preferred for improving the clarity and/or color of the rinse solution, and even more preferably where the laundered fabrics are washed and/or rinsed by hand. When washing and/or rinsing fabrics by hand, the appearance of the rinse solution is commonly used by the consumer as an indicator or the state of the fabrics and whether soils and/or detergents are still present. The result is that consumers continue to rinse until a clear and/or light colored rinse solution is obtained, which in many cases erroneously leads to excess rinsing of the fabrics. The use of the compositions of the present invention and methods incorporating the use of the compositions will enable consumers to rinse surfactants more quickly from their fabrics and will provide a rinse solution that has improved color and/or clarity. These elements will prompt consumers to reduce the amount of rinsing that they perform on these fabrics.

Method for Reducing Surfactant Residue Via a Chaperone Mechanism

The present invention also relates to a method for reducing surfactant residue on a fabric via a chaperone mechanism, whereby a fabric containing surfactant residue is contacted by a rinse-added fabric treatment composition containing a residue reducing component. The residue reducing component has a hydrophilic portion and a surfactant-attracting portion selected from the group consisting of a hydrophobic moiety, an alkoxy moiety, a charged moiety, and a mixture thereof. Preferably the charged moiety has a charge that is opposite to that of the surfactant residue to be removed from the fabric. Once a rinse bath solution is formed by adding the rinse-added fabric treatment composition to water, the fabric is contacted with the rinse bath solution. Without intending to be limited by theory, it is believed that the residue reducing component then is attracted to the surfactant residue, via ion-paring, hydrophobic/hydrophilic interactions, etc., such that the surfactant residue and the residue reducing component form a non-covalent bond. The hydrophilic portion of the residue reducing component then assists in pulling the surfactant residue (which is still non-covalently bonded to the residue reducing component) into the rinse bath solution, and away from and off of the fabric, so as to reduce the level of surfactant residue in or on the fabric fibers.

The compositions according to the present invention may be used in neat or diluted form. However the compositions herein are typically used in diluted form in a laundry operation. "In diluted form", it is meant herein that the compositions for the treating of fabrics according to the present invention may be diluted by the user, preferably with water. Such dilution may occur for instance in hand washing applications as well as by other means such as in a washing machine. Said compositions can be diluted 1 to about 10,000, preferably 1 to about 5,000, and more preferably from 1 to about 300 to 1 to about 600 times. Typical rinse dilutions are of about 500 to 550 times (approx. 20 ml in 10 L) for use in hand rinsing, and of about 375–425 times for use in a automated and non-automated washing machine (90 ml in 35 liters). These amounts will vary where the composition is to be used in combination with a fabric softener composition. Where the use of a fabric softener composition is desired, it is preferred that the laundered fabrics be rinsed in a composition of the present invention early in the rinse cycle or during a first rinse cycle, and that the fabric softening composition be added late in the rinse cycle or during the last rinse cycle where multiple rinse cycles are used.

For the purposes of the present invention the term "contacting" is defined as "intimate contact of a fabric with an aqueous solution of the hereinabove described composition which comprises a suds suppressing system." Contacting typically occurs by soaking, washing, rinsing, spraying the composition onto fabric, but can also include contact of a substrate inter alia a material onto which the composition has been absorbed, with the fabric. Hand treatment is a preferred process. Temperatures for treatment can take place at a variety of temperatures, however, treatment typically occurs at a temperature less than about 50° C., preferably from about 5° C. to about 45° C.

III. Fabric Treatment Product

A. Rinse-Added Fabric Conditioning Composition

The fabric treatment product of the present invention comprises a fabric treatment composition as described hereinabove.

B. Container

The fabric treatment product of the present invention comprises a container or package for containing the rinse-added fabric treatment composition. Containers and packages manufactured from various polymeric materials using thermoforming techniques are well known and commonly used to advantage to contain liquid fabric conditioning compositions. Descriptions of such containers and packages and various manufacturing techniques may be found in U.S. Pat. No. 4,917,269 issued Apr. 17, 1990 to Fuchs et al.; U.S. Pat. No. 4,989,757 issued Feb. 5, 1991 to Krall; U.S. Pat. No. 5,020,692, issued Jun. 4, 1991 to Darr; U.S. Pat. No. 6,032,829 to Mar. 7, 2000 to Geisinger et al.; U.S. Pat. No. 6,085,949 issued Jul. 11, 2000 to Zimny et al.; U.S. Pat. No. 6,123,231 issued Sep. 26, 2000 to Geisinger; and U.S. Pat. No. 6,209,762 issued Apr. 3, 2001 to Haffner et al.; all of said patents being incorporated herein by reference.

C. Instructions for Use

The fabric treatment product of the present invention further comprises a set of instructions associated with the container that include an instruction to the consumer to use the rinse-added fabric treatment composition to improve the color and/or clarity of the rinse solution. Fabric treatment compositions are not known to improve the appearance of the rinse solution and such an instruction is particularly useful to the consumer when using a fabric treatment composition. Further, such an instructions is even more preferable when washing and/or rinsing fabrics by hand.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A rinse-added fabric treatment composition for reducing residue on fabric and improving the color and/or clarity of a fabric rinse solution, the composition comprising:

(A) an appearance-enhancing agent to improve the clarity and/or color of the rinse solution selected from the group consisting of a peroxygen bleaching agent, a bluing agent and mixtures thereof;

(B) a second residue reducing component selected from the group consisting of a suds suppressing agent, pH control agent, metal ion control agent, crystal growth inhibitor, dispersant, cyclodextrin and derivatives thereof; scum dispersant, and mixtures thereof;

(C) an anionic surfactant scavengenger wherein the anionic surfactant scavenger has the formula:

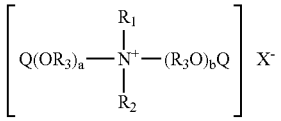

wherein $R_1$ is a $C_{12-15}$ alkyl group, wherein $R_2$ is methyl, wherein each $R_3$ is ethyl, wherein each Q is H, wherein a is about 7.5, wherein b is about 7.5, and wherein $X^-$ is chloride (D) the balance adjunct ingredients.

2. The composition of claim 1, wherein the suds suppression agent comprises an anti-foaming agent selected from the group consisting of silicone compound, polyethylene glycol derivatives, fatty acids and their salts, high molecular weight hydrocarbons, copolymers of ethylene oxide and propylene oxide, secondary alcohols, mono-alkyl quaternary ammonium compounds, and mixtures thereof.

3. The composition of claim 1, wherein the pH control agent is present in an effective amount to maintain the fabric treatment composition at a pH between about 1.5 and about 6.0.

4. The composition of claim 3, wherein the pH control agent comprises citric acid.

5. The composition of claim 4, wherein the citric acid is present in the composition in an amount from about 2% to about 22% by weight of the composition.

6. The composition of claim 1, wherein the anionic surfactant scavenger is present at a level of from about 0.05% to about 10% by weight of the composition.

7. The composition of claim 1, wherein the peroxygen bleaching agent comprises hydrogen peroxide.

8. The composition of claim 7, wherein the peroxygen bleaching agent is present in the fabric treatment composition at a level less than about 15% by weight of the composition.

9. The composition of claim 1, wherein the bluing agent is stable in the presence of the peroxygen bleaching agent.

10. The composition of claim 1, wherein the bluing agent is present at a level of from about 0.004% and about 0.1% by weight of the composition.

11. The composition of claim 1, wherein the adjunct ingredients are selected from the group consisting of an acidifying agent, alkaline agent, perfume, non-ionic surfactant, cationic charge booster, electrolyte, dye transfer inhibitor, and mixtures thereof.

12. A method for improving the color and/or clarity of a fabric rinse solution, the method comprising the steps of:

washing fabrics in an aqueous detergent solution;

adding to the rinse solution an effective amount of the composition of claim 1; and rinsing the fabrics in an aqueous rinse solution.

13. The method of claim 12, wherein the liquid fabric treatment composition further comprises a second residue reducing component selected from the group consisting of a suds suppressing agent, pH control agent, metal ion control agent, crystal growth inhibitor, dispersant, cyclodextrin and derivatives thereof, scum dispersant, and mixtures thereof.

14. The method of claim 12, wherein the fabrics are rinsed by hand.

15. A fabric treatment product, said product comprising:

a liquid fabric treatment composition comprising an effective amount of the composition of claim 1;

a container for the composition; and a set of instructions associated with the container, said set of instructions comprising an instruction to a consumer to use the fabric treatment composition to improve the color and/or clarity of the rinse solution.

16. The product of claim 15, wherein the liquid fabric treatment composition further comprises a second residue reducing component selected from the group consisting of a suds suppressing agent pH control agent metal ion control agent, crystal growth inhibitor, dispersant, cyclodextrin and derivatives thereof, scum dispersant, and mixtures thereof.

17. The product of claim 15, wherein said set of instructions comprises an instruction to a consumer to use the fabric treatment composition when rinsing fabrics by hand.

* * * * *